United States Patent [19]

Spitz

[11] 4,070,718

[45] Jan. 31, 1978

[54] BOX SPRING RETAINER

[76] Inventor: Melvin P. Spitz, 619 N. Elm Drive, Beverly Hills, Calif. 90210

[21] Appl. No.: 722,706

[22] Filed: Sept. 13, 1976

[51] Int. Cl.[2] ..... A47C 19/04

[52] U.S. Cl. ..... 5/207; 5/200 R

[58] Field of Search ..... 5/181, 176 R, 200–202, 5/207, 209, 238, 309; 24/263 PJ

[56] References Cited

U.S. PATENT DOCUMENTS

| | | | |
|---|---|---|---|
| 598,454 | 2/1898 | Weaver, Jr. | 5/238 |
| 3,551,282 | 12/1970 | Holgue | 5/309 |
| 3,952,345 | 4/1976 | Spitz | 5/207 |

*Primary Examiner*—Casmir A. Nunberg
*Attorney, Agent, or Firm*—Whann & McManigal

[57] ABSTRACT

A bed frame of the type having a pair of side rails interconnected by one or more crossbars to provide a support for a box spring, and in which adjustable box spring locating and retaining clips are provided on the side rails to permit the sides of the box spring to extend beyond the side rails, and to hold the box spring against shifting movements in relation to the supporting bed frame.

22 Claims, 6 Drawing Figures

BOX SPRING RETAINER

BACKGROUND OF THE INVENTION

The present invention relates generally to the field of bed frame structures.

Heretofore, it has been generally known to provide box spring locating and retaining clips on the side rails of a bed frame. For example, as shown in U.S. Pat. Nos. 3,537,114 and 3,683,429, such clips may be permanently secured as by riveting at desired locations along the side rails. On the other hand, U.S. Pat. No. 3,510,887 teaches the concept of a clip which may be attached to the side rail in a manner permitting its selective adjustable movement along the rail and location at any desired position. U.S. Pat. No. 3,952,345 discloses a still different concept in which the clip is arranged to be mounted at specified locations on the side rail, but incorporate structural features which permit adjustment of the clip transversely of the side rail to positions in which it will firmly grip the box srping and hold it against sliding movements in relation to the supporting bed frame. The present invention is in general of the last above-noted concept, and is considered to be an improvement thereover.

SUMMARY OF THE INVENTION

The present invention is more particularly concerned with an improved retainer clip for a box spring, as supported on a bed frame.

It is one object and feature of the disclosed clip retainer of the present invention to provide a simplified and more sturdy construction which is devoid of springs or loose and separate parts which could become lost or misplaced.

A further object is to provide a clip retainer for a box spring, which utilizes a latching member of unique design, and which permits of smaller increments of adjustment.

Another object and feature of the present invention resides in the provision of a cap covering for the box spring engaging part of the clip, this cap being constructed of a material having a high degree of frictional contact will effectively hold the box spring against longitudinal slippage on the bed frame by forces which may be applied to the box spring during shifting movements of the bed when making it up or in changing its location.

Further objects and features of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENT

Figure 1:
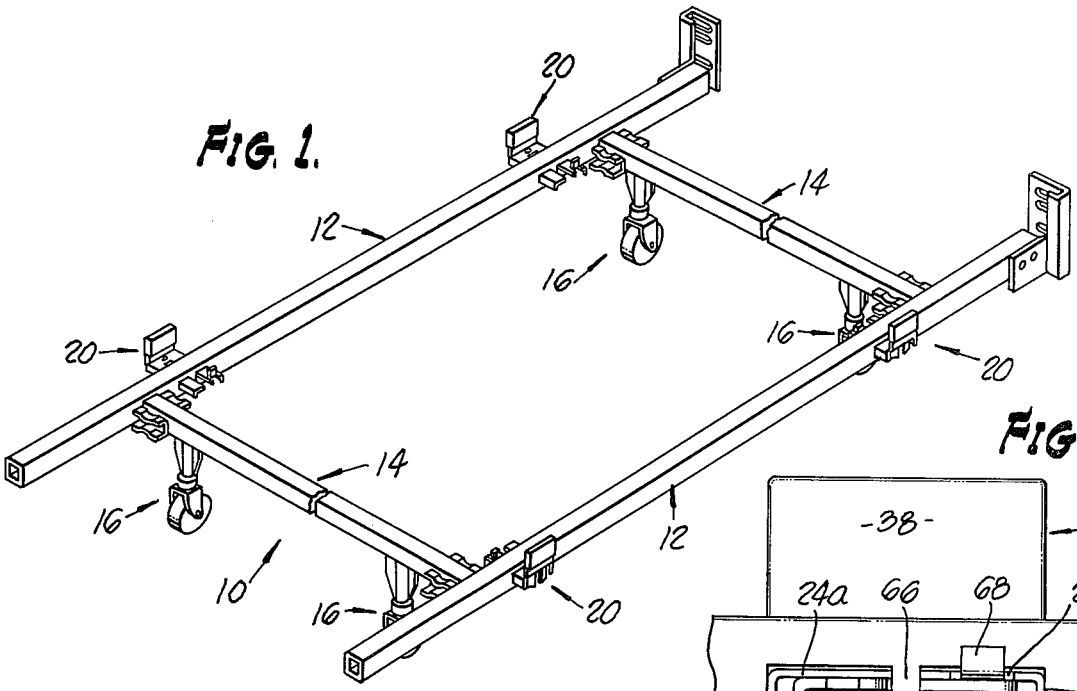
FIG. 1 is a perspective view of a bed frame structure having box spring retaining clips according to the present invention.
Figure 5:
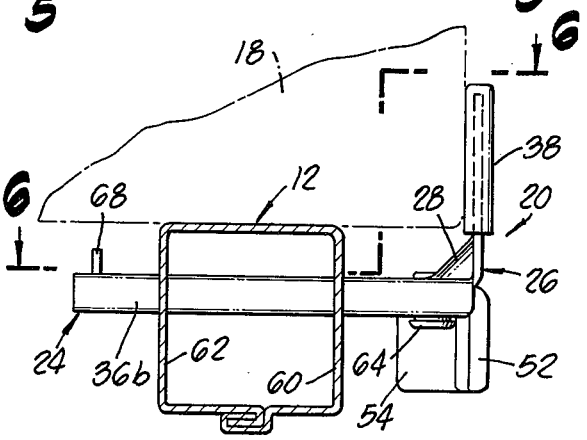
FIG. 5 is a side elevational view of the same, partly in section, as seen substantially on line 5—5 of FIG. 2, and showing its association with a supported box spring.

Referring now specifically to the drawings, for illustrative purposes, a bed frame embodying the features of the present invention is indicated in its entirety by numeral 10 in FIG. 1, and is shown generally as comprising a pair of spaced parallel side rails 12, which are interconnected by one or more crossbars 14. The bed frame structure is provided with appropriate leg assemblies, as generally indicated at 16, for supporting the bed frame in an elevated position in which it provides a supporting frame for an associated box spring 18, as shown in phantom lines in FIG. 5.

The side rails are provided with adjustable box spring retaining tabs or clips 20 which embody the features of the present invention and comprise a structure, as will be more fully explained subsequently, that avoids the inherent disadvantages of the conventional fixed clip which under some conditions may extend beyond the sides of the supported box spring in such a manner as to provide a dangerous hazard. The retaining clip of the present invention embodies features of design which result in operating characteristics which are considered to be superior to those heretofore provided for locating and holding the box spring in relation to the bed frame.

More specifically, the box spring retaining clips 20, according to the present invention, are constructed as unitary assemblies which can be mounted in the side rails 12 of the bed frame, and as thus mounted may be adjustably extended and retracted with respect to the associated side rail so as to snugly engage the adjacent side of the box spring.

Each clip is fabricated to provide a generally L-shaped body structure formed to provide a base leg 24 and a shorter right-angled leg 26 at one end thereof, reinforcing gussets 28 preferably being provided at the juncture of the legs 24 and 26 to provide additional strength.

Figure 2:
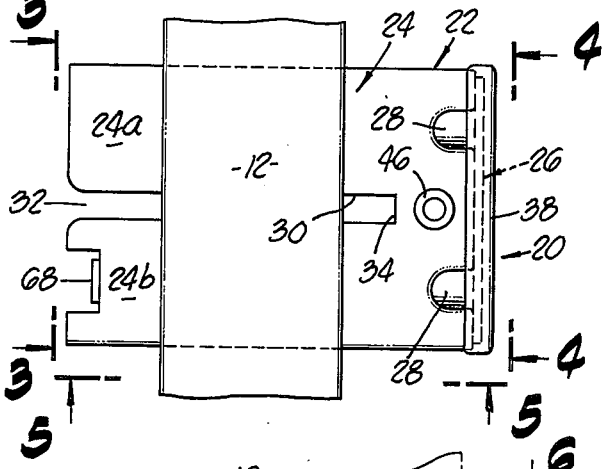
FIG. 2 is a fragmentary plan view of the box spring retaining clip, and showing the clip mounted on an associated side rail.
Figure 3:
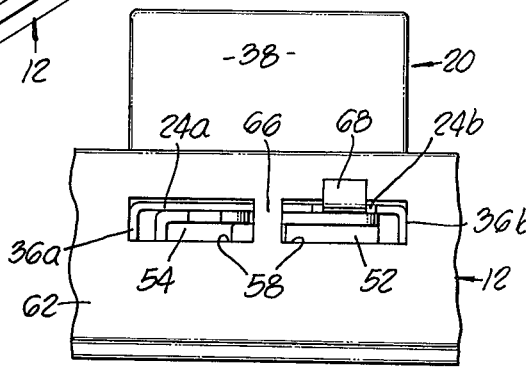
FIG. 3 is a fragmentary side elevational view as seen from line 3—3 of FIG. 2.
Figure 4:
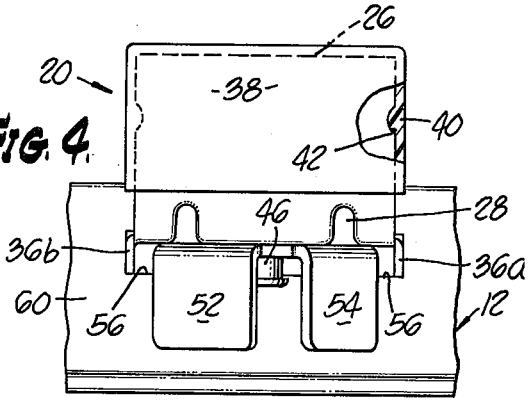
FIG. 4 is a fragmentary elevational view as seen along line 4—4 of FIG. 2.

As shown in FIG. 2, the base leg 24 is separated into spaced apart parallel extending leg portions **24*a*, 24*b*, by means of an elongate medial slot 30 having an outer end opening 32 and an inner closed end 34. The opposite edges of the base leg 24 are formed respectively with edge flanges 36*a* and 36*b* which extend in the same direction, and in a direction from the leg 24 opposite to that of the leg 26**.

The leg 26 is covered by a cap member 38 of a material which will have a substantially non-slipping frictional engagement with the associated box spring. The cap is shown as being of molded form and is removably affixed to the end leg 26 by providing one or more internal projections as indicated at 40, these projections being arranged to seat in suitable edge notches or recesses 42 of the end leg, when the cap is pushed over the leg and into its attached normal position.

Figure 6:
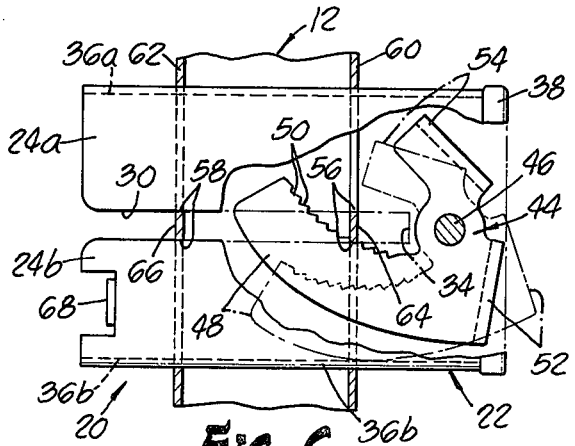
FIG. 6 is a top plan view, as seen substantially along line 6—6 of FIG. 5, parts being in section, and portions being cut away to disclose details of the latching mechanism.

As best shown in FIG. 6, the body structure 22 carries a latch member 44 which is positioned on the underface of the base leg 24 for swinging movements on a pivot pin 46 positioned adjacent the inner closed end 34, and between this closed end and the jointure of the base leg 24 and end leg 26. The latch member 44 is pivoted between its ends and is fabricated to provide a curved or arcuate inner arm portion 48 which is laterally offset at its base with respect to the pivot pin 46, and extends outwardly for movement, over the medial slot 30. The edge of the arm 48 facing the slot is provided with a series of right-angled serrations 50. The outer end of the latch member 44 is fabricated to provide a pair of finger-engageable latch actuating tabs 52, 54, these tabs being integrally formed by similarly deflected portions of the latch member, and are angularly positioned on opposite sides of the pivot pin 46. These finger-engageable tabs are positioned generally below the leg 26, and as thus arranged provide means for selectively swinging the latch member in one direction or the other. For example pressure applied to the tab 52 operates to move the inner arm portion 48 in a clockwise direction, as seen in full lines in FIG. 6, while application of pressure against the tab 54 operates to move the inner arm portion 48 in a counter-clockwise direction, movement in this direction being limited by engagement of the arm portion with the adjacent edge flange 36*b*, as shown in phantom lines.

As further shown in FIG. 6, the retainer clip is operatively associated with a side rail 12 by positioning the base leg 24 of the body structure for sliding movement in transversely aligned slots 56 and 58, respectively, in an outer wall 60 and inner wall 62 of the associated side rail. As thus mounted, the leg portions 24*a* and 24*b* are in straddled relation to webs 64 which separate the slots 56, and the web 66 which separates the slots 58. As thus mounted on the rail 12, the retainer clip is adjustably movable between extended and retracted positions, the side flanges 36*a* and 36*b* serving as supporting guide runners. The retainer clip, as thus described, is retained in operative association with the side rail 12 by means of an integrally formed deflected portion of the base leg 24*b* which forms an abutment stop, as indicated at 68. This stop limits outward movement of the clip structure, while inner movement of the clip structure is determined by the abutment of the inner closed end 34 of the slot 30 against the web 64.

With the clip retainer mounted on a side rail as thus explained above, the clip is readily movable towards a retracted position, wherein the clip may be latched against extendable movement simply by applying pressure against the finger tab 52 so as to move the arm portion 48 into a position in which the serrations thereon will engage an edge of the web 64 and thus retain the clip against extendable movement from contact engagement of the cap 38 with an edge of the supported box spring. To release the clip, it is only necessary to apply pressure against the finger-engageable tab 54 to disengage the serrations from engagement with the edge of the web 64, whereupon the clip retainer may be moved outwardly to an extended position disengaged from the box spring. It will be appreciated that in the latched position of the latch member, outward movement of the retainer clip will tend to more forcibly engage the latch member arm 48 with the associated web 64, due to the offset relationship of the arm 48 with respect to the pivot 46.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In a bed frame having an elongate side rail with a surface providing a support for a box spring adapted to project outwardly therebeyond, a box spring locating and retainer clip structure, comprising:

a. a generally L-shaped body structure having a base leg and a right-angled end leg at one end thereof, said legs being of fixed width;

b. means adjustably mounting said body on said rail for movements in extendable and retractable directions with said base leg extending transversely of the rail below said surface and with said end leg being positioned outwardly of said surface and projecting above the plane thereof to engage a projecting side of the box spring; and c. means for releasably latching said body against movement in said extendable direction from an adjusted position, including a manually operable latch member pivoted on one face of said base leg adjacent its juncture with the end leg for swinging movement over said one face to latched and unlatched positions with respect to a portion of the associated rail.

2. A bed frame as set forth in claim 1, wherein said side rail comprises side wall means extending below said surface and having slot means therein for guidingly receiving said base leg therein for sliding movements in opposite directions in response to said body movements; and means at the respective ends of said base leg for limiting said movements of said body in said extendable and retractable directions.

3. A bed frame as set forth in claim 2, wherein said limiting means at the other end of said base leg comprises an integrally formed portion of said base leg.

4. A bed frame as set forth in claim 2, wherein said limiting means at said one end of said base leg comprises an abutment in spaced relation to said right-angled end leg.

5. A bed frame as set forth in claim 1, wherein said side rail comprises spaced apart vertical sides having slots therein for receiving and supporting said base leg, certain of said slots having a portion for latching engagement by said latching means.

6. A bed frame as set forth in claim 2, wherein said side wall means comprises a pair of spaced apart parallel side walls, and said slot means comprises slots in said walls aligned transversely of said rail for supporting said base leg, the slots in each side wall being separated by a web.

7. A bed frame as set forth in claim 2, wherein said means for releasably latching said body includes lateral serrations carried by said latch member for engagement with an adjacent portion of said side rail, said serrations being manually disengageable from the portion of said side rail to permit adjusting movements of said body.

8. A bed frame as set forth in claim 6, in which the base leg is divided into parallel portions by a longitudinally extending slot having an outer open end and a closed inner end to permit disposition of the leg portion in straddling relation in said slots on opposite sides of said webs.

9. A bed frame as set forth in claim 8, in which said latch member is formed with edge serrations for engagement with one of said webs.

10. A bed frame as set forth in claim 9, in which said latch member is swingably supported between its ends on a pivot adjacent the closed end of said slot, with one end of said latch member having the edge serration thereon, and the other end having finger engageable means for selectively actuating said latch member to latching position with the serrations engaged with the adjacent web edge, and to an unlatched position with the serrations disengaged from the web.

11. A bed frame as set forth in claim 9, in which the engagement of the serrations with the associated web restrains said body against movement in an extended direction, but permits adjusting movements in a retractable direction.

12. A bed frame as set forth in claim 9, in which the points of engagement of the respective serrations with the associated web are laterally offset from the center of rotation of the latch member, whereby the application of a force tending to move the body in an extendable direction will tend to rotate the latch member in a direction to increase the engaging forces between the latch member and said web.

13. A bed frame as set forth in claim 10, in which said one end is curved.

14. A bed frame as set forth in claim 10, in which the finger engageable means comprises a pair of tabs angularly spaced with respect to the axis of said pivot, whereby the application of pressure against one of said tabs rotates the latch member to a latching position and pressure on the other of said tabs rotates the latching member to an unlatched position.

15. A bed frame as set forth in claim 1, inwhich the base leg has side edge flanges, and in which the latch member is positioned in the space between said edge flanges which serve as abutment stops for limiting pivotal movements of said latch member.

16. A bed frame as set forth in claim 8, in which the closed end of said slot is engageable with an adjacent web to limit the movement of said body in the retractable direction.

17. A bed frame as set forth in claim 1, in which the end leg is covered by a removable cap member of a material capable of substantially non-slipping frictional engagement with the box spring.

18. An adjustable box spring locating and retaining clip for a bed frame side rail, comprising:

a. a generally L-shaped body structure having a base leg and a right-angled end leg at one end thereof, said legs being of fixed width;

b. a latch member supported by a pivot on said base leg for swinging movement within the lateral confines of said base leg, said latch member having one end formed as an arm and being provided with serrations on one edge thereof, and its other end being formed to provide finger engageable means for selectively pivotally swinging said latch member to latching and non-latching positions.

19. A clip according to claim 18, in which said base leg is formed with side edge flanges extending in the same direction, and wherein said latch member is positioned for movement in the space between said side flanges.

20. A clip according to claim 18, in which the base leg includes a longitudinally extending medial slot, said slot having an outer open end and an inner closed end spaced from the base of said end leg, and wherein the latch member pivot is positioned adjacent the closed end of the slot and the arm end of the latch member is movable over said slot.

21. A clip according to claim 18, in which the finger engageable means comprises a pair of tabs positioned generally below the end leg of said body.

22. A clip according to claim 18, which includes a removably mounted cover cap for said end leg of a material having a relatively high sliding friction characteristic.

* * * * *